US008579637B2

(12) United States Patent
Liskow

(10) Patent No.: US 8,579,637 B2
(45) Date of Patent: Nov. 12, 2013

(54) ELECTRICAL CONNECTING SYSTEM

(75) Inventor: Uwe Liskow, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/194,034

(22) Filed: Jul. 29, 2011

(65) Prior Publication Data

US 2012/0040541 A1 Feb. 16, 2012

(30) Foreign Application Priority Data

Aug. 11, 2010 (DE) ..... 10 2010 039 185

(51) Int. Cl.
*H01R 12/00* (2006.01)

(52) U.S. Cl.
USPC ..... 439/67

(58) Field of Classification Search
USPC ..... 439/493, 77, 67, 495
See application file for complete search history.

(56) References Cited

U.S. PATENT DOCUMENTS 3,602,870 A * 8/1971 Willard ..... 439/74
3,923,364 A * 12/1975 Shapiro et al. ..... 439/493
3,993,383 A * 11/1976 Marino ..... 439/848
4,251,389 A * 2/1981 Gilbert et al. ..... 502/107
5,907,347 A * 5/1999 Nagahata et al. ..... 347/208
6,579,125 B1 * 6/2003 Nagahata et al. ..... 439/629
6,648,675 B2 * 11/2003 Welschholz et al. ..... 439/492
7,263,200 B2 * 8/2007 Chang et al. ..... 381/410

FOREIGN PATENT DOCUMENTS

DE 10 2007 032535 1/2009

* cited by examiner

*Primary Examiner* — Phuong Dinh
(74) *Attorney, Agent, or Firm* — Kenyon & Kenyon LLP

(57) ABSTRACT

An electrical connecting system is described for contacting an electronic module with multiple printed conductors of a flexible printed circuit. The printed conductors are enclosed between a lower and an upper cover film, and the electronic module has at least one circuit board hich is embedded in a plastic housing. According to the invention, the electronic module has at least one contact spring. A first end section of the contact spring is connected in an electrically conductive manner to the circuit board via a connecting point, and a second end section of the contact spring has two legs which extend in a U shape, between which a printed conductor is situated. An electrical contact which is less susceptible to failure results on both sides between the contact spring and the printed conductor. Also described is an electrical connecting system in which the printed conductor is electrically contacted on one side, and instead of at least one one-piece contact spring, in each case a connecting piece and a spring clip are present. The electrical connecting systems allow an electrically reliable connection to be established which is also sufficiently capable of withstanding mechanical load, by simply inserting the printed circuits into the contact springs, or between the connecting pieces and the spring clips in the electronic modules.

7 Claims, 4 Drawing Sheets

ELECTRICAL CONNECTING SYSTEM

RELATED APPLICATION INFORMATION

The present application claims priority to and the benefit of German patent application no. 10 2010 039 185.9, which was filed in Germany on Aug. 11, 2010, the disclosure of which is incorporated herein by reference.

FIELD OF THE INVENTION

The present invention relates to an electrical connecting system.

BACKGROUND INFORMATION

Electronic system components are becoming increasingly important in motor vehicles. In particular, ensuring a reliable electrical connection between an electronic module, for example a mechatronic module located in an oil pan for controlling a motor vehicle transmission, causes significant problems for the sensors, the actuators, and other electronic modules.

The electrical connection between a circuit board having electronic and electromechanical components which is usually located in the electronic module, and the external assembly and connection technology (ACT) is often established using bonding wires which connect the connecting points of the circuit board in an electrically conductive manner via glazed connecting pins in the module housing. The individual connecting pins are connected to a punch grid as ACT, for example, by laser welding, and the webs of the punch grid are later removed. The circuit board may be a printed circuit board or a so-called low-temperature co-fired ceramic (LTCC) hybrid having an electronic circuit mounted thereon.

Moreover, DE 10 2007 032 535 A1, among other sources, refers to providing a circuit board for transmission control of a motor vehicle directly on a flexible printed circuit (FPC) and to connect the printed conductors of the printed circuit directly to connecting points on the circuit board using bonding wires. After the contact is established, the circuit board is encased by a cover, which may optionally contain a plastic material for sealing. However, this design complicates function tests in particular, as well as the controlled pre-aging of the installed electronic modules.

SUMMARY OF THE INVENTION

An electrical connecting system for contacting an electronic module with multiple printed conductors of a flexible printed circuit is disclosed, the printed conductors being enclosed between a lower and an upper cover film, and the electronic module having at least one circuit board which is embedded in a plastic housing. According to the exemplary embodiments and/or exemplary methods of the present invention, the electronic module has at least one contact spring, a first end section of the contact spring being connected in an electrically conductive manner to the circuit board via a connecting point, and a second end section of the contact spring having two legs which extend in a U shape, between which a printed conductor for establishing an electrically conductive connection is situated. As a result of the U-shaped end section of the contact spring, inserted printed conductors of the printed circuit are firmly clamped, thus securely fixing them in position. In addition to the force-fit connection, the U-shaped contact spring ensures a reliable electrical contact, with high current-carrying capacity on both sides, and therefore under all occurring operating states of a motor vehicle. To simplify the insertion of the printed conductors into the contact springs, in particular for multipole connections having multiple printed conductors, a tool may be used for spreading the contact springs. To further improve the contact reliability, the contact spring may be thermally joined to the printed conductor, at least in places. The thermal or integral joining may be achieved, for example, by laser welding, laser soldering, resistance welding, friction welding, induction welding, ultrasonic welding, or the like. For the case that the connecting system is used in aggressive media, for example in a transmission fluid pan, the electrical contacting may be achieved by clamping the printed conductors into the contact springs and subsequently thermally joining same. To allow proper electrical contacting, at least one recess is introduced into the lower and/or upper cover film in a connecting region of the printed circuit to be contacted, so that the printed conductors of the printed circuit are exposed, at least in places. These recesses in the cover films may have any desired geometric shape, but may be circular, rectangular, square, or oval.

To increase the contact pressure between the contact springs and the printed conductors in the printed circuit, at least in places, each leg of the contact springs may have at least one conical or hemispherical prominence. To further optimize the contact reliability, strain relief in various forms may be provided. The strain relief may be achieved, for example, by using clamping contacts which are not used for electrical conduction, or by introducing the printed circuit which is bent at an angle of 90°. Alternatively, a chip protection cover may be provided in the connecting region of the flexible printed circuit, which at the same time is used as strain relief. To seal the connecting system from the harmful influence of fluids and to prevent short circuits caused by chips, after the printed conductors are inserted the contact springs may be sprayed with a plastic material and/or hermetically sealed on all sides using a plastic compound. The contact springs may be made of an electrically conductive metallic material which at the same time has good elastic properties. To simplify the manufacture of an electronic module which is provided with the electrical connecting system according to the exemplary embodiments and/or exemplary methods of the present invention, generally multiple U-shaped contact springs are centrally extrusion-coated with a plastic material to form a contact spring strip. However, this procedure is not absolutely necessary. The contact springs may, for example, be punched from a flat metal sheet to form a punch grid. The punch grid is subsequently subjected to a shaping process, which generally has multiple steps, in order to form the specific U-shaped geometry of the contact spring. As a result of the punch grid, the contact springs are precisely aligned with one another and may be easily handled. After the injection molding process, the contact springs may be removed from the punch grid by separating the connecting webs. In such a contact spring strip, multiple contact springs may be uniformly spaced apart from one another in parallel, and thus combined into a unit which may be easily handled and positioned. The connecting points of a circuit board are subsequently connected in an electrically conductive manner to the individual contact springs, using known connection techniques. This may be carried out by laser welding, laser soldering, resistance welding, or friction welding, for example. To simplify the contacting process, the circuit board, which is generally mounted on a base plate, is aligned together with the contact spring strips in a support tool. Lastly, the circuit board together with the contact springs is placed into a mold and extrusion-coated on all sides with a plastic material to form the plastic housing of the completed electronic module. The circuit board generally contains multiple electronic and/or electromechanical components, for example resistors, capacitors, coils, diodes, light-emitting diodes, transistors, integrated analog and/or digital circuits, relays, magnets, motors, and a number of different types of sensors and actuators for various physical measured variables. The electronic module formed with the aid of the circuit board may be, for example, a so-called transmission control unit or motor control unit (TCU/MCU) for motor vehicles, or sensors and/or actuators.

In addition, according to the exemplary embodiments and/or exemplary methods of the present invention one alternative specific embodiment of an electrical connecting system has at least one linear connecting piece, in particular at least one flat pin, the connecting piece being connected in an electrically conductive manner to the circuit board, in particular with the aid of a wire, and a printed conductor being situated between the connecting piece and a spring clip. In contrast to the first embodiment variant, no one-piece U-shaped contact spring is provided, and the electrical connection between the circuit board and the connecting piece, which may be designed, for example, as a flat pin which is injected into the plastic housing or as a contact plate, is established inside the plastic housing of the electronic module, which may be with the aid of conventional bonding technology. This results, among other things, in reduced material usage compared to the U-shaped contact springs. In addition, the integration of the connecting pieces and the spring clips into existing standard shapes of plastic housings of electronic modules is simplified.

A further difference from the first embodiment variant is that the electrical contact occurs only on one side, between the associated printed conductor of the printed circuit and the associated connecting piece. The only function of the spring clip is to build up the punctiform contact pressure required for establishing a secure electrical connection. As a result, the spring clip in this embodiment variant may be made of an electrically conductive metallic material, or also of a plastic material or any given combination thereof. The spring clip or the spring clip strip is integrated into the housing of the electronic module in an electrically insulating manner. To simplify the manufacturing process, at least the spring clips are extrusion-coated in a middle section with a suitable plastic material in order to create a spring clip strip having multiple spring clips which are uniformly spaced apart from one another. A similar procedure is carried out with the connecting pieces. Before the connecting pieces or the spring clips are extrusion-coated, once again they are part of a prefabricated one-piece punch grid. After the injection molding process, the connecting pieces or the spring clips may be removed from the particular punch grids. During manufacture of an electronic module, the circuit board located on a base plate is initially aligned and fixed on a workpiece support. The connecting pieces, which may be combined into a strip, are subsequently positioned on the workpiece support and electrically connected to the respective connecting points on the circuit board with the aid of conventional bonding technology. An electrically insulating plastic compound which, however, has high thermal conductivity, for example a thermally conductive adhesive, may be introduced, at least in places, between the base plate and the circuit board. Lastly, the base plate having the circuit board, together with the strip which supports the spring clips or combines same, is introduced into a suitable mold and extrusion-coated on all sides with a thermoplastic or duroplastic plastic compound (so-called molding compound). This molding compound represents the final, electrically insulating plastic housing of the completed electronic module.

The exemplary embodiments and/or exemplary methods of the present invention are explained in greater detail below with reference to the drawings.

DETAILED DESCRIPTION

Figure 1:
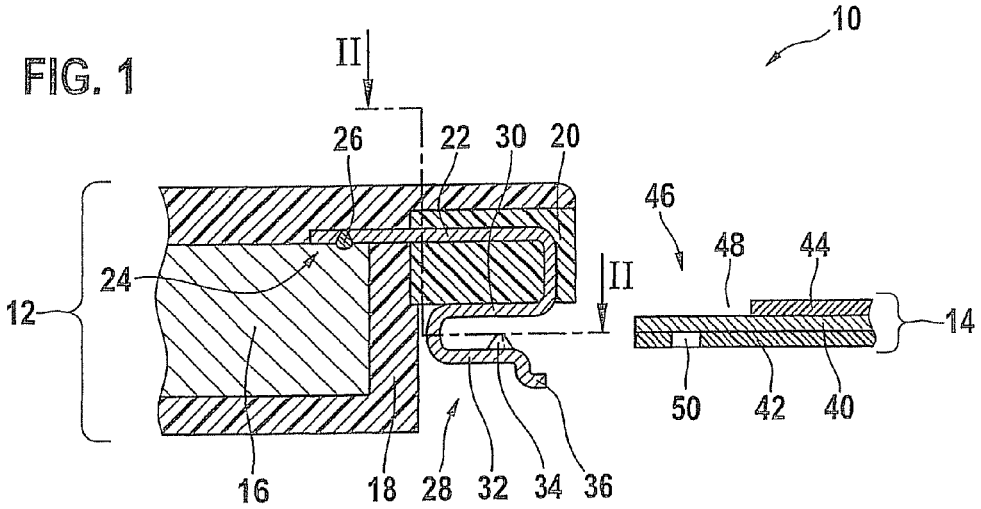
FIG. 1 shows a schematic side view of a first embodiment variant of the connecting system.

FIG. 1 shows a first embodiment variant of the connecting system according to the present invention.

A connecting system 10 includes an electronic module 12 and a flexible printed circuit 14. In the pulled-out position illustrated in FIG. 1, the electrical contact between printed circuit 14 and electronic module 12 is not yet established. Electronic module 12 includes, among other elements, a circuit board 16 which is enclosed by a plastic housing 18. Plastic housing 18 is formed from an electrically insulating thermoplastic or duroplastic plastic material. Multiple electronic and/or electromechanical components, not illustrated, are situated on circuit board 16. In addition, a contact spring strip 20 having at least one contact spring 22 is integrated into plastic housing 18. In general, contact spring strip 20 connects multiple contact springs which are uniformly spaced apart from one another in parallel. Contact spring strip 20 may be made of the same plastic material as plastic housing 18. A first end section 24 of contact spring 22 is connected to circuit board 16, or to the electronic and/or electromechanical components situated thereon, in the region of a connecting point 26. Electrical connecting point 26 is implemented with the aid of known thermal joining processes, for example laser welding, laser soldering, or resistance welding. A second end section 28 of contact spring 22 has two legs 30, 32, which are bent in a U shape and extend approximately parallel at a distance from one another. Upper leg 30 extends uniformly in contact spring strip 20 at a distance from and parallel to end section 24. A small prominence 34 is present in the region of lower leg 32, and in the exemplary embodiment shown has a conical design. An end of lower leg 32, not denoted by a reference numeral, extends at a slight offset 36. This offset is used, among other things, to apply an optional tool for spreading legs 30, 32 to allow printed circuit 14 to be inserted more easily or, if necessary, removed from contact spring 22. In connecting system 10, printed circuit 14 is inserted parallel to a plane, not denoted by a reference numeral, of circuit board 16. Printed circuit 14, which is designed in a known manner, includes, among other elements, at least one printed conductor 40 which may be formed from a copper alloy. Printed circuit 14 generally has multiple printed conductors which are uniformly spaced apart from one another in parallel. For electrical insulation and for mechanical stabilization, the printed conductors are laminated on both sides with a lower cover film and an upper cover film 42, 44, respectively. In a connecting region 46, an upper recess 48 is introduced into upper cover film 44, and a lower recess 50 is introduced into lower cover film 42, so that the printed conductors are exposed at this location. Upper recess 48 is approximately rectangular, and extends over the entire width of printed circuit 14, while lower recess 50 has the geometry of a circle whose diameter approximately corresponds to the width of printed conductor 40. Printed circuit 14 is inserted at connecting region 46 into contact spring 22 and fixedly clamped between legs 30, 32. Conical prominence 34 engages with circular recess 50 in lower cover film 42, on the one hand thus creating electrical contacting of printed circuit 14 on both sides, and on the other hand making it more difficult for printed circuit 14 to be pulled out (strain relief) from contact spring 22 in an uncontrolled manner. To improve the effect of the strain relief, corrugation, not illustrated, may be provided in printed circuit 14. As a result of the force-fit clamping, on the one hand printed circuit 14 is mechanically securely fixed, and on the other hand electrical contact on both sides is established between contact spring 22 and printed conductor 40. To achieve a sufficient clamping effect, a distance, not denoted by a reference numeral, between the two legs 30, 32 may be dimensioned in such a way that it is less than the material thickness of printed conductor 40 plus a thickness of lower cover film 42. To provide redundancy of the electrical connection and at the same time achieve improved pull-out resistance, printed conductor 40 may be thermally joined to the two legs 30, 32 of contact spring 22 in the region of prominence 34. To improve the resistance against harmful environmental influences, the connecting system may be sprayed with a plastic material and/or extrusion-coated with a plastic material.

Figure 2:
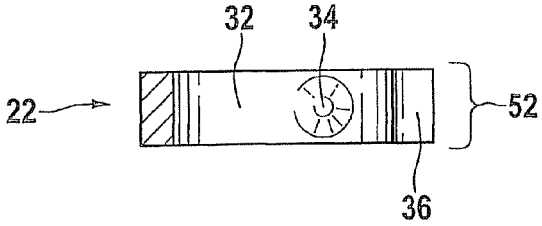
FIG. 2 shows a top view of the contact spring according to FIG. 1 along section line II-II.

FIG. 2 shows a top view of contact spring 22 along section line II-II in FIG. 1.

Lower leg 32 of contact spring 22 is essentially rectangular, and bears conical prominence 34, which projects from the plane of the drawing, and offset 36 at the end. A width 52 of contact spring 22 may be dimensioned in such a way that it is approximately less than or equal to a width, not denoted by a reference numeral, of the printed conductors in printed circuit 14. A distance, not denoted by a reference numeral, between the contact springs accommodated in contact spring strip 20 may correspond to width 52 of contact spring 22. In order to conform to international standards, a value of 1.27 mm or 2.54 mm, for example, may be selected for width 52 of contact spring 22.

Figure 3:
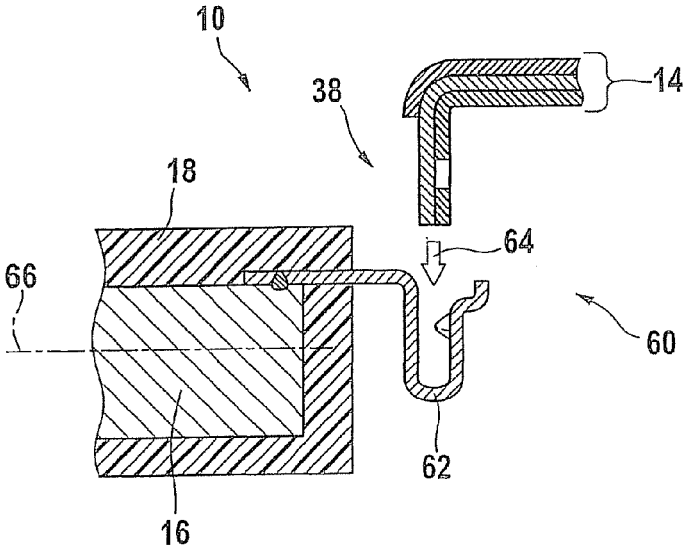
FIG. 3 shows one specific embodiment of strain relief.

FIG. 3 illustrates one possible specific embodiment 60 of introducing the printed circuit at an angle greater than 0° with respect to electronic module 12 of connecting system 10.

In contrast to the specific embodiment according to FIG. 1, a contact spring 62 is integrated directly into the plastic housing of electronic module 12 and connected to circuit board 16 via a connecting point, not illustrated. A contact spring strip is not provided. In addition, flexible printed circuit 14, in a departure from FIG. 1, is introduced into contact spring 62 from above in the direction of white arrow 64, at an angle of up to 90° with respect to plane 66 of the circuit board. In addition, printed circuit 14 is bent by approximately 90° in connecting region 38 and led to contact spring 62. In other respects, the design of contact spring 60 is the same as for contact spring 22 described for FIG. 1, so that with regard to further design details, reference is made to the description of FIG. 1.

Figure 4:
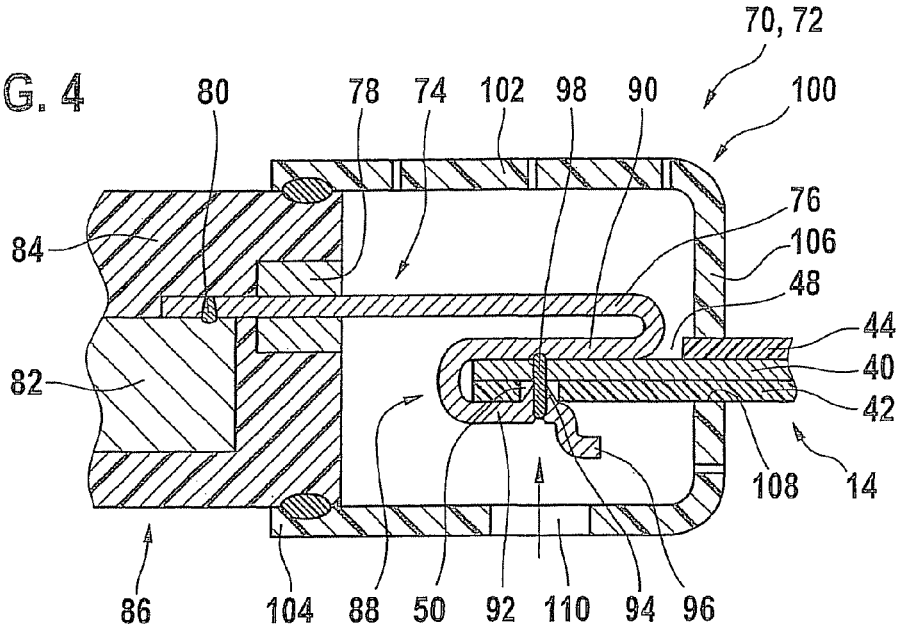
FIG. 4 shows another specific embodiment of strain relief together with a chip protection cover.

FIG. 4 illustrates another specific embodiment of a connecting system 72 which has high pull-out resistance, and which also ensures protection from short circuits caused by foreign particles.

A first end section 74 of a contact spring 76 is integrated into a contact spring strip 78. End section 74 is electrically connected to a circuit board 82 in the region of a connecting point 80. Circuit board 82 is embedded in a plastic housing 84 to form an electronic module 86. Contact spring 76 has a second end section 88 having an upper leg 90 and a lower leg 92 which extend in parallel at a distance from one another, thus forming an approximately U-shaped geometry. However, in contrast to the specific embodiment of contact spring 22 according to FIG. 1, in the present case upper leg 90 immediately abuts first end section 74. Once again a conical prominence 94 and an offset at the end are provided in the region of lower leg 92. The electrical contacting is achieved once again by inserting printed circuit 14 between the two legs 90, 92. The contacting takes place on both sides by the clamping effect of upper leg 90 and a top side of printed conductor 14 in combination with lower leg 92 and a bottom side of printed conductor 14 via recesses 48, 50 in cover films 44, 42, respectively. In addition, prominence 94 snaps into lower recess 50. In contrast to the specific embodiment according to FIG. 1, for creating redundant electrical contacting, a connecting point 98 is additionally provided which is established by thermal or integral joining. This connecting point connects the two legs 90, 92 to printed conductor 40. The protective function is provided by a cap 100 whose two legs 102, 104 are appropriately connected to plastic housing 84. Cap 100 at the same time provides bend protection for printed circuit 14. A rear wall 106 of cap 100 has a leadthrough 108 for printed circuit 14 to pass through. In addition, multiple boreholes, not denoted by a reference numeral, are introduced into the cap to allow a surrounding fluid which may be present, for example a transmission fluid, to flow through. A recess 110 in lower leg 104, which may be formed as a borehole, has a larger diameter than the other boreholes, not denoted by a reference numeral. Thus, with the aid of this recess 110, connecting point 98 may be created by thermal joining, for example by laser welding or laser soldering, in the region of prominence 94. For this purpose, a laser beam of suitable intensity and geometric dimensions is conducted through recess 110. It is not absolutely necessary to introduce lower recess 50 into printed circuit 14 in advance, since the laser beam used for thermal joining generally has sufficiently high radiation energy to vaporize lower cover film 42 in this region during the joining process. The diameters of the boreholes in cap 100 should be dimensioned in such a way that foreign particles, for example metal chips, metallic grit, metallic production residues, and the like which could result in short circuits are not able to pass through.

Figure 5:
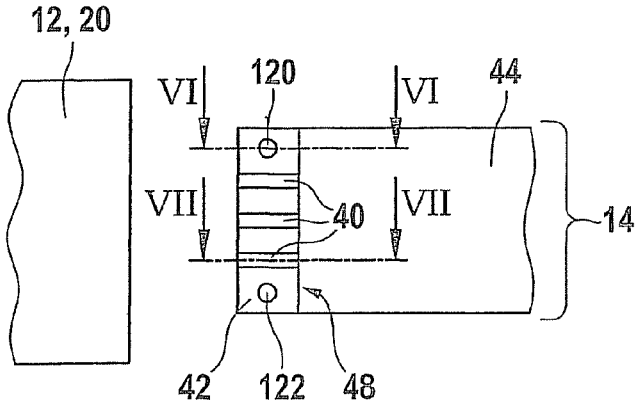
FIG. 5 shows a top view of the connecting region of a flexible printed circuit having a continuous rectangular recess on the end.
Figure 6:
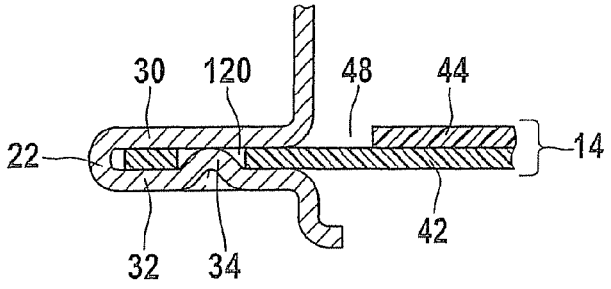
FIG. 6 shows a cross-sectional illustration of the printed circuit along section line VI-VI in FIG. 5.
Figure 7:
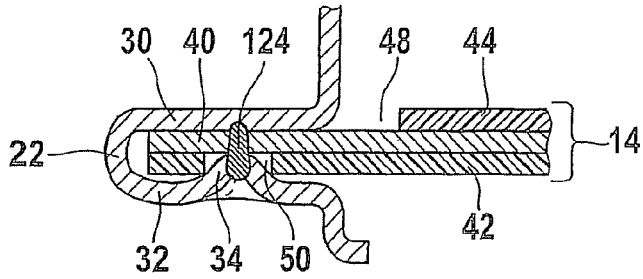
FIG. 7 shows a cross-sectional illustration of the printed circuit along section line VII-VII in FIG. 5.

FIGS. 5 through 7, to which reference is jointly made in the further description, illustrate two further options for implementing an introduction of the printed circuit without the need for additional components.

FIG. 5 schematically shows contact spring strip 20 of electronic module 12, printed circuit 14 having the two cover films 42, 44, and three printed conductors, of which only one printed conductor is provided with reference numeral 40. The printed conductors are exposed in the region of rectangular recess 48 in upper cover film 44. Two through recesses 120, 122, in the present case designed as boreholes, are introduced into lower cover film 42. As is apparent from FIG. 6, when printed circuit 14 is inserted into contact spring strip 20, prominence 34 snaps into recess 120, and lower leg 32 of contact spring 22 presses lower cover film 42 against upper leg 30. As a result of this combined snap-in/clamping principle, improved pull-out resistance is obtained without the presence of additional design elements. Similarly, the prominence of a further contact spring, not illustrated here, snaps into second recess 122, at the same time clamping lower cover film 42 between the two legs of the second contact spring in the region of recess 48. Effective improvement in the pull-out resistance is thus achieved on both sides of printed circuit 14 without using additional components. In the present embodiment, the two contact springs need not be electrically connected to circuit board 16 inside electronic module 12; i.e., they are not used to transmit electrical signals and/or electrical power, and are used only for strain relief. Additional contact springs which are not electrically connected may be provided to increase the effectiveness of the strain relief.

FIG. 7 illustrates another specific embodiment of introduction for flexible printed circuit 14. Prominence 34 is engaged with recess 50 in lower cover film 42, and in the region of recess 48 printed conductor 40 is pressed with a defined force against upper leg 30 of contact spring 22 by the spring action of lower leg 32. As a result of this clamping effect, printed circuit 14 is fixed in position and provided with strain relief immediately after printed circuit 14 is inserted into the clamping springs, thus simplifying subsequent manufacturing steps. The same snap-in/clamping principle applies for further contact springs, not illustrated here, which may be provided for increasing the mechanical load capacity of the connecting point. A connecting point 124 is additionally provided for further optimizing the effect of the strain relief. Upper leg 30, printed conductor 40, and lower leg 32 are joined thermally, i.e., integrally, in the region of this connecting point 124, resulting in high mechanical load capacity. Recess 50 in lower cover film 42 is not absolutely necessary if the laser power used for the thermal joining is great enough to melt through the cover film.

Figure 8:
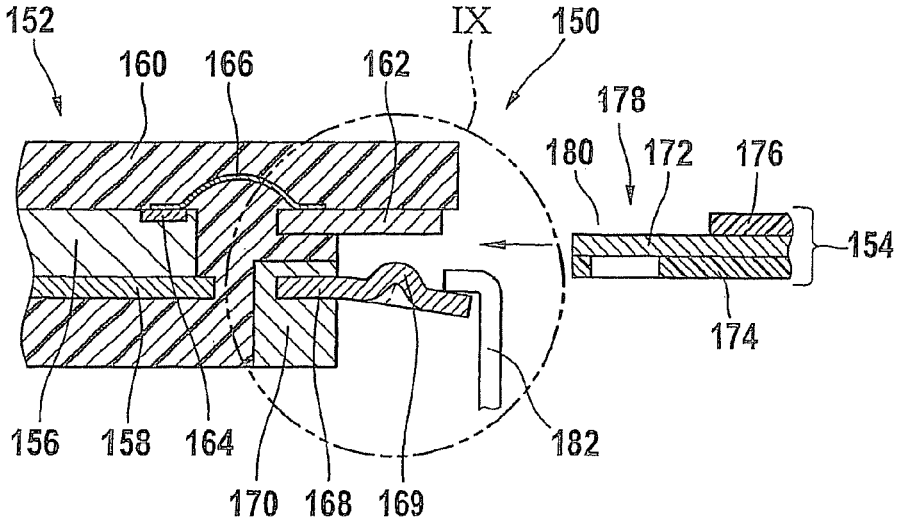
FIG. 8 shows a side view of a second embodiment variant of the connecting system, having a printed circuit which is not yet inserted.
Figure 9:
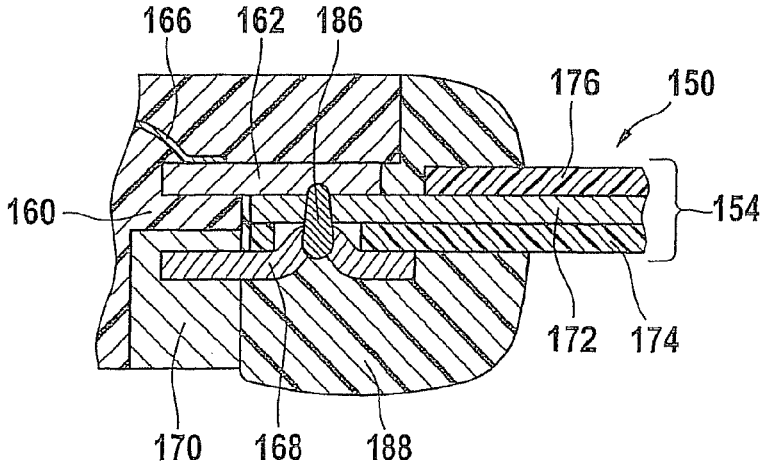
FIG. 9 shows an enlarged detail from FIG. 8.

FIGS. 8 and 9, to which reference is jointly made in the further description, illustrate a second specific embodiment of the connecting system according to the present invention. In contrast to the specific embodiment according to FIGS. 1 through 7, in which a one-piece contact spring is used, in the present case the mechanical and electrical connection of the printed circuit takes place via a two-piece design element in the form of a linear connecting piece or flat pin, and a spring clip which cooperates with same.

A connecting system 150 includes, among other elements, an electronic module 152 and a flexible printed circuit 154. In the illustrated position, the electrical contact between printed circuit 154 and electronic module 152 is not yet established. Electronic module 152 also includes a circuit board 156 which is mounted on a metallic base plate 158. Circuit board 156 and base plate 158 are encapsulated on all sides in a plastic housing 160. Multiple electronic and/or electromechanical components, not illustrated, are present on circuit board 156. Base plate 158 on the one hand is used as a heat sink, and on the other hand allows mounting of electronic module 152 in an installation space. In addition, at least one linear metallic connecting piece 162, in the present case designed as a flat pin as an example, is integrated into plastic housing 160, i.e., is co-injected into plastic housing 158. Alternatively, electrically conductive connecting piece 162 may be designed as a contact plate. Multiple connecting pieces are generally necessary for complete electrical contacting of printed circuit 154, which generally has a multipole design. For the manufacturing process for electronic module 152, the connecting pieces may be uniformly spaced at a distance from one another or combined in a connecting piece strip (not illustrated here), similarly as for the contact spring strip according to FIG. 1. This connecting piece strip may be made of the same plastic material as plastic housing 160 in order to form a mechanically strong bond between the connecting piece strip and surrounding plastic housing 160. Plastic housing 160 may be produced by extrusion-coating circuit board 156 and base plate 158 in a mold having an inserted connecting piece strip. In addition, multiple connecting surfaces (so-called contact pads), of which one connecting surface 164 is visible, are present on circuit board 156. In the present case, the electrical connection between connecting piece 162 and connecting surface 164 is established by a wire 166, in particular a bonding wire made of a suitable metal alloy. Connecting piece 162 in turn is electrically connected via printed conductors to multiple electronic and/or electromechanical components, not denoted by a reference numeral, on circuit board 156. A spring clip 168 is situated beneath each of the connecting pieces. Spring clip 168 has an approximately V-shaped, upwardly facing prominence 169 for increasing the elasticity. Spring clip 168 continues in two short linear sections on both sides of prominence 169; for the sake of clarity in the drawing these sections are not provided with reference numerals. In each case, a linear section of each spring clip 168 is accommodated in a spring clip strip 170, in particular to simplify installation and alignment. Spring clip strip 170 together with circuit board 156, base plate 158, and connecting piece 162 is extrusion-coated in a suitable mold, using an insulating plastic compound, to form plastic housing 160. The sole function of the spring clips is to press printed circuit 154 against the connecting pieces situated thereabove with a defined contact force in order to establish the desired electrical contact. Thus, the spring clips may also be formed from a suitable electrically insulating material, for example a plastic material, which, however, must have sufficient spring elasticity. For example, plastic materials having integrated fiber reinforcement are conceivable. Alternatively or additionally, the spring clips may also be formed from a metallic material. The spring clips as well as the connecting pieces are uniformly spaced in the respective strips at a distance from one another, with what may be a standardized grid spacing of 1.27 mm or 2.54 mm, for example. Printed circuit 154 once again includes at least one printed conductor 172 which is laminated with a lower cover film 174 and an upper cover film 176. A rectangular recess 180 is inserted into upper cover film 176 in an electrical connecting region 178, so that printed conductor 172 is exposed at this location. When printed circuit 154 is guided between connecting piece 162 and spring clip 168 for establishing an electrical connection, the mechanical contact force exerted by spring clip 168 ensures secure electrical contact between printed conductor 172 and connecting piece 162. Strain relief is thus provided at the same time. To simplify the insertion of printed circuit 154, a tool 182 may be provided to be able to bend spring clip 168 slightly downward. In contrast to the specific embodiment according to FIG. 1, in the present case the printed conductors are not electrically contacted on both sides. Electrical contact is present only between metallic connecting piece 162 and a top side, not denoted by a reference numeral, of printed conductor 172. To achieve sufficiently secure electrical contact, a distance, not denoted by a reference numeral, between prominence 169 and connecting piece 162 may be less than or equal to a material thickness of printed conductor 172 plus the thickness of lower cover film 174. FIG. 9 shows a detail of connecting system 150 from FIG. 8, in which a connecting point 186 has been additionally created between connecting piece 162 and printed conductor 172 and spring clip 168. Connecting point 186 may be created by integral, in particular thermal, joining, for example by laser welding or laser soldering joints. To enable the thermal joining, spring clip 168 is formed primarily from a metallic material. In this specific embodiment, with regard to the electrical contacting and the mechanical securing of printed circuit 154 the mechanical action of force of spring clip 168 has only secondary importance against uncontrolled pulling out (strain relief). Integrally bonded connecting point 186 results in a significant improvement in the reliability of the electrical contact, which is particularly important when large acceleration forces are present. The uncontrolled pulling out of printed circuit 154, if it occurs at all, is conceivable only under application of great force, and generally results in tearing off of printed conductor 172, spring clip 168, and/or connecting piece 162. To protect connecting system 150 from harmful environmental influences, and from metallic foreign particles which may result in short circuits, the connecting system may be sprayed with a suitable electrically insulating plastic material, or completely sealed or encased with a plastic compound. Sealing improves the electrical insulation of adjoining connecting pieces. The sealing may be used similarly as for the connecting systems according to FIGS. 1 through 7 in order to increase the resistance to harmful environmental influences, in particular in the form of chemically aggressive gases and/or liquids.

Figure 10:
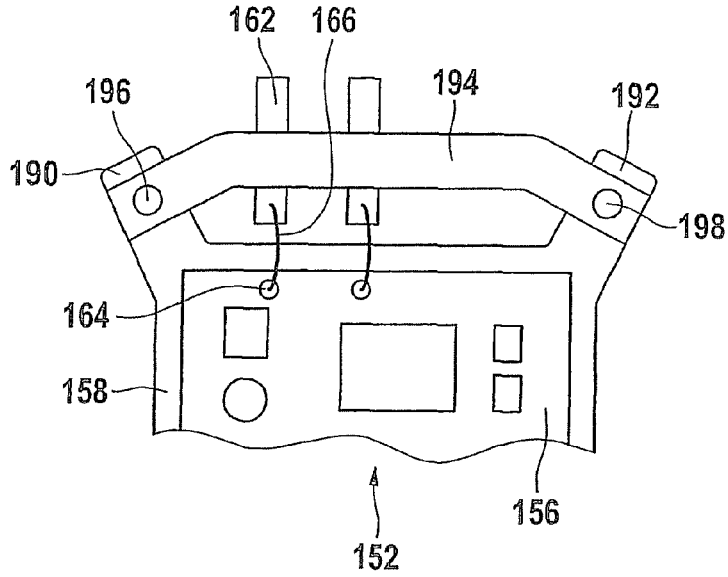
FIG. 10 shows a top view of a base plate having a circuit board, and a connecting piece strip which is aligned with and fastened to the base plate.

FIG. 10 shows electronic module 152 with circuit board 156 mounted on base plate 158.

Base plate 158 generally has at least four outwardly facing fastening tabs, of which only two fastening tabs 190, 192 are illustrated which are representative of the remainder. Connecting piece 162, as well as a further connecting piece not provided with a reference numeral, is integrated into a connecting piece strip 194. Connecting surface 164 is electrically connected to connecting piece 162 via wire 166, in particular a bonding wire. Connecting piece strip 194 allows ease in handling during manufacture, as well as precise positioning of the connecting pieces in relation to circuit board 156. Connecting piece strip 194 is aligned with the aid of two boreholes 196, 198 in tabs 190, 192, respectively, into which pins, not illustrated, of connecting piece strip 194 are insertable, which may be with a light press force. These pins are situated beneath connecting piece strip 194. If necessary, after insertion the pins may be mushroomed, i.e., riveted, on the underside in order to non-detachably fix them in position. Unlike the specific embodiment of connecting piece strip 194 shown in FIG. 10, the connecting piece strip may also surround circuit board 156 in a frame shape, i.e., in particular in a rectangular shape, so that a connection of printed circuits to electronic module 152 is possible from all sides. In addition, connecting piece strip 194 may be designed in such a way that printed circuits may be connected on at least two or three sides of electronic module 152. If connecting piece strip 194 is fixed to tabs 190, 192, as shown in FIG. 10, wire 166 between connecting surface 164 and connecting piece 162 may be provided using known bonding processes, for example. A similar procedure is carried out for all other wires and connecting surfaces. Other connecting techniques may likewise be used to establish an electrically conductive connection between the connecting surfaces and the connecting pieces. If all connecting pieces together with the associated connecting surfaces are electrically connected by wires, the entire system is placed in a suitable mold. Spring clip strip 170 (see FIG. 8 in particular) is then inserted and positioned beneath connecting piece strip 162. Lastly, the components present in the mold are extrusion-coated on all sides with a suitable thermoplastic or duroplastic plastic compound to create plastic housing 160 of electronic module 152, at the same time thus providing a hermetic seal against harmful environmental influences.

Figure 11:
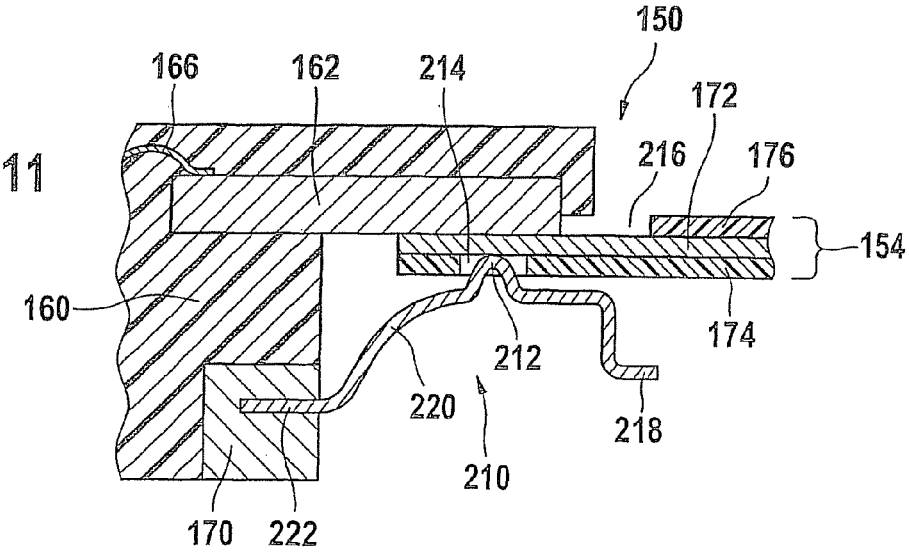
FIG. 11 shows a schematic side view of the second embodiment variant of the connecting system, having a curved spring clip in an alternative design.

FIG. 11 illustrates the electrical connecting system according to FIG. 8, except that a spring clip 210 is used which has a different geometric shape than that of spring clip 168 according to FIG. 8.

Connecting piece 162 is integrated into plastic housing 160 of electronic module 152 and electrically connected via wire 166 to circuit board 156, not illustrated here. A spring clip 210 is mounted in spring clip strip 170. Spring clip strip 170 may be co-injected into plastic housing 160. Spring clip 210 likewise has a small V-shaped prominence 212 which faces upwards and snaps into a recess 214 in lower cover film 174. For the case that spring clip 210 is formed from an electrically conductive material, the spring clips are electrically insulated with respect to one another and with respect to circuit board 156 or base plate 158 by spring clip strip 170 or plastic housing 160. Prominence 212 which rests against recess 214 prevents, among other things, printed circuit 154 from being pulled out in an uncontrolled manner. As a result of rectangular recess 216 in upper cover film 176, printed conductor 172 is exposed at that location. The electrical contact, which in the present case is on one side, results between connecting piece 162 and the exposed top side of printed conductor 172 in the region of recess 216, a sufficiently high punctiform contact pressure between printed conductor 172 and connecting piece 162 being ensured by spring clip 210. On the right side of prominence 212, spring clip 210 has a linear section having a small offset 218. This offset 218 is used to apply a spreading tool for spring clip 210 in order to simplify insertion or pulling out of flexible printed circuit 154 by bending spring clip 210 downward. On the left side of prominence 212, spring clip 210 initially continues in a downwardly curved, arched section 220 having an approximate quarter-circle shape, and is adjoined by a linear, horizontally extending section 222 which is used to fasten spring clip 210 in connecting piece strip 170. As the result of curved, arched section 220, among other things the upwardly directed action of force of spring clip 210 is increased. To further improve the reliability of the electrical contact or to reliably prevent flexible printed circuit 154 from being pulled out in an uncontrolled manner, a connecting point may be additionally provided in the region of prominence 212 which once again is created by thermal joining. An integral bond between prominence 212, printed conductor 172, and metallic connecting piece 162 results from this connecting point, not illustrated here. For the case that spring clip 210 is formed primarily from a nonmetallic material, it is necessary to integrate a small metal plate, not illustrated, into the region of prominence 212 of spring clip 210 in order to achieve an integral connection of spring clip 210 to the printed conductor or connecting piece 162.

Both embodiment variants of electrical connecting system 10, 150, even under the most adverse environmental influences, which prevail in a transmission fluid pan or in an engine oil pan of a motor vehicle, for example, ensure an electrically reliable connection between flexible printed circuits 14, 154 and electronic modules 12, 152 which is also capable of withstanding mechanical load and has high pull-out resistance 70. In addition, connecting systems 10, 150 are simply and easily mateable, which in particular allows final function controls and aging procedures to be carried out on individual electronic modules 12, 152, regardless of the external circuitry. Connecting the external assembly and connection technology (ACT) and the flexible printed circuits to electronic modules 12, 152 takes place only after completion of the connecting system.

What is claimed is:

1. An electrical connecting system for contacting an electronic module with multiple printed conductors of a flexible printed circuit, comprising:

multiple printed conductors for connecting the electronic module with a flexible printed circuit, the printed conductors being enclosed between a lower and an upper cover film, and the electronic module having at least one circuit board which is substantially fully embedded in a plastic housing;

wherein the electronic module has at least one contact spring, a first end section of the contact spring being connected in an electrically conductive manner to the circuit board via a connecting point, and a second end section of the contact spring having two legs which extend in a U shape, between which a printed conductor for establishing an electrically conductive connection is situated.

2. The electrical connecting system of claim 1, wherein the printed conductor is at least one of clamped between the two legs and is thermally joined to at least one leg of the contact spring.

3. The electrical connecting system of claim 1, wherein the lower and the upper cover film each have at least one recess in a connecting region of the printed circuit.

4. The electrical connecting system of claim 1, wherein a leg of the contact spring has at least one prominence which engages with the recess in the lower cover film.

5. The electrical connecting system of claim 1, wherein the at least one contact spring is formed from an electrically conductive and elastic material.

6. The electrical connecting system of claim 1, wherein the at least one contact spring is accommodated in at least one contact spring strip.

7. The electrical connecting system of claim 1, wherein strain relief of the printed circuit is provided.

* * * * *